US009186780B2

(12) United States Patent
Dumaine et al.

(10) Patent No.: US 9,186,780 B2
(45) Date of Patent: Nov. 17, 2015

(54) HAMMER UNION WRENCH

(71) Applicants: Marc Dumaine, Calgary (CA); Larry Matthewson, Calgary, CA (US)

(72) Inventors: Marc Dumaine, Calgary (CA); Larry Matthewson, Calgary, CA (US)

(73) Assignee: HUWE INC, Calgary, Alberta ( * ) Notice: Subject to any disclaimer, the term of this patent is extended or adjusted under 35 U.S.C. 154(b) by 234 days.

(21) Appl. No.: 13/801,606

(22) Filed: Mar. 13, 2013

(65) Prior Publication Data

US 2014/0260822 A1 Sep. 18, 2014

(51) Int. Cl.

| | |
|---|---|
| ***B25B 13/50*** | (2006.01) |
| ***B25B 23/00*** | (2006.01) |
| ***B25B 19/00*** | (2006.01) |

(52) U.S. Cl.

CPC ..... *B25B 13/50* (2013.01); *B25B 19/00* (2013.01); *B25B 23/0021* (2013.01)

(58) Field of Classification Search

CPC ..... B25B 13/02; B25B 13/48; B25B 13/50; B25B 23/0021

USPC ..... 81/119, 176.1, 177.2, 180.1

See application file for complete search history.

(56) References Cited

U.S. PATENT DOCUMENTS

| | | | | | |
|---|---|---|---|---|---|
| 183,344 | A | * | 10/1876 | Taber | 81/176.1 |
| 455,606 | A | * | 7/1891 | Byrne | 81/176.1 |
| 579,748 | A | * | 3/1897 | Haley | 7/138 |
| 804,008 | A | * | 11/1905 | Hopkins | 81/176.1 |
| 1,207,046 | A | * | 12/1916 | Howard | 81/176.1 |
| 1,527,772 | A | * | 2/1925 | Baird | 81/176.1 |
| 1,608,432 | A | * | 11/1926 | Ryan | 81/164 |
| 1,627,435 | A | * | 5/1927 | Hooben | 81/176.1 |
| 1,709,075 | A | * | 4/1929 | Howard | 81/176.1 |
| 1,763,353 | A | * | 6/1930 | Heller | 81/176.1 |
| 1,945,406 | A | * | 1/1934 | Adams | 81/119 |
| 2,360,163 | A | * | 10/1944 | Sadler | 81/176.1 |
| 2,420,458 | A | * | 5/1947 | Barker | 81/176.1 |
| 2,503,364 | A | | 4/1950 | Viets | |
| 2,539,262 | A | * | 1/1951 | Moore | 81/119 |
| 2,599,668 | A | | 6/1952 | Taylor | |
| 2,691,912 | A | | 10/1954 | Jones | |
| 2,986,054 | A | * | 5/1961 | Lurie | 81/177.2 |
| 3,604,106 | A | | 9/1971 | Borries | |
| 4,013,313 | A | * | 3/1977 | Gardels | 294/17 |
| D271,275 | S | | 11/1983 | Richilano | |
| 4,483,220 | A | | 11/1984 | Shindelar | |
| 4,597,123 | A | * | 7/1986 | Cobe, Jr. | 7/138 |
| 4,644,600 | A | * | 2/1987 | Fugate | 7/166 |
| 4,713,991 | A | * | 12/1987 | Gaug | 81/176.1 |
| 4,960,014 | A | * | 10/1990 | Kelley | 81/177.2 |
| 5,791,704 | A | * | 8/1998 | Thompson et al. | 294/17 |

(Continued)

FOREIGN PATENT DOCUMENTS

| | | |
|---|---|---|
| DE | 202004010688 | 10/2004 |
| WO | 2010083577 A1 | 7/2010 |

*Primary Examiner* — David B Thomas

(57) ABSTRACT

A tool for actuating hammer unions. The tool provides for an arcuate tool head having an aperture which receives the lug or tab of the union. Extending outwardly from the arcuate tool head is a lever member which is designed to receive a handle [selected by the user for appropriate length and torque] for the user to hold and apply the necessary amount of torque to tighten or loosen the hammer union. By receiving the tab in the arcuate head, the user is precluded from damaging the tabs or lugs since no impact is received by the latter and a maximum amount of work can be done safely by the user. Structural features are also provided to prevent improper use of the tool.

31 Claims, 7 Drawing Sheets

(56) References Cited

U.S. PATENT DOCUMENTS

| | | | | |
|---|---|---|---|---|
| D462,600 | S | 9/2002 | Gilbert et al. | |
| 2002/0104410 | A1 | 8/2002 | Wang | |
| 2004/0025649 | A1* | 2/2004 | Rugee | 81/177.2 |
| 2004/0055427 | A1 | 3/2004 | Stier | |
| 2004/0206213 | A1 | 10/2004 | Hsien | |
| 2005/0183550 | A1* | 8/2005 | Day | 81/177.2 |
| 2005/0279193 | A1* | 12/2005 | Darby et al. | 81/177.2 |
| 2006/0075855 | A1* | 4/2006 | Fitzpatrick | 81/177.2 |
| 2010/0005934 | A1* | 1/2010 | Guilbault | 81/177.2 |
| 2012/0048069 | A1 | 3/2012 | Powell, Jr. | |

* cited by examiner

HAMMER UNION WRENCH

TECHNICAL FIELD

The present invention relates to a tool and more particularly, relates to a hammer union wrench for safely applying torque to hammer unions of all sizes.

BACKGROUND OF THE INVENTION

Hammer unions are well known in the in the oil, gas and mining industry. Hammer unions are used to fasten pipe together for low and high pressure applications and as is known, these unions typically include lugs or tabs which require engagement with a hammer for tightening and loosening. As is presently conducted in this field, a worker typically actuates the union by swinging a hammer. This applies a force to the tabs or lugs in order to rotate the union into a tightening or loosening position. As such, the lugs or tabs typically incur a significant amount of force from repetitive striking. One of the problems is that despite the fact that the lugs or tabs are obviously made of the same material forming the mechanical fastener or union, metal fatigue can certainly occur after repeated strikes. This can result in breakage of the lug or tab completely from the entire body of the fastener which would then result in the lug or tab becoming a projectile presenting a dangerous situation or fragments or pieces of the lug becoming dislodged from the lug itself, acting as shrapnel. These are serious issues and can result in injury to not only the worker operating the hammer, but also surrounding members of a work team. A further problem that exists with this type of system is that the swinging of an object towards the hammer union can present a hazardous situation, particularly where a worker is not alert to his surroundings.

In order to circumvent this problem, a number of solutions have been proposed in the prior art, one of which is indicated in United States Patent Publication No. US 2012/0048069, with the published author being named as Powell Jr. In the publication, it is disclosed that the Applicant provides a hammer union wrench comprising a tool head having a substantially circular or disk shaped tool head body with an opening there through axially and transversally. The axial opening also includes slots which receive tabs associated with the hammer union. Although this is a useful arrangement, it requires the engagement of at least two of the tabs or bosses of the hammer union and fairly specific alignment of the tool head relative to the hammer union. This is not an issue in situations where the union is free of any debris, but presents difficulties in use where the union has been exposed to debris or is encumbered by ice, snow, etc. A further perceived limitation to this arrangement is that there does not appear to be any compensation for adding or augmenting the torque that is applied to the union by the worker. The arrangement provides the head of the tool in direct alignment with a stock handle shown in the drawings as number 14. Accordingly, it would appear that the worker would still have to exert a significant amount of effort to activate the tool head in order to tighten or loosen the union.

Other arrangements that are known are spanner wrenches. An example of one such arrangement is shown in U.S. Pat. No. 2,830,480, issued Apr. 15, 1958 to Brame for a spanner wrench for tubing unions. Brame provides a wrench having a semicircular tool head with a series of recesses and projections positioned on the tool head. The recesses and projections mate in registration with similarly configured recesses and projections in the tubing union. This arrangement, similar to that set forth in the publication discussed supra requires precise alignment and potentially also has the possibility of slippage from the tubing union which could result in injury during use.

Earlier attempts in the art to improve the efficiency and overall construction of such wrenches is shown in U.S. Pat. No. 464,084, issued Dec. 1, 1891, to Robinson. The Patentee provides a curved jaw tool head with a tooth positioned within the jaw and guiding ears associated therewith.

In U.S. Pat. No. 2,691,912, issued Oct. 19, 1954, Jones provides an anvil type wrench. The wrench effectively comprises a body suitable for use in pipe union fittings.

The art has presented further variations on these overall arrangements. A further example of which is demonstrated in U.S. Pat. No. 1,528,892, issued Mar. 10, 1925 to Pigott et al. The patent provides for a wrench which has a U-shaped head internally directed towards portion 8.

In view of the limitations in the art, it would appear that there is still a need for a high efficiency wrench which does not require impact or regular forces to be applied to tabs or lugs of a pipe union or hammer union which causes premature ware and the hazards noted above. The present invention not only satiates these requirements but also provides for improved arrangement where torque can be applied to the tool with a greater degree of efficiency and less effort by the worker.

SUMMARY OF THE INVENTION

One object of one embodiment of the present invention is to provide an improved wrenched suitable for use in a pipe union or hammer union environment.

One aspect of an embodiment of the present invention is to provide a tool, comprising:

- an arcuate tool head;
- an aperture through said head for receiving first tab means of pipe fitting;
- an abutment surface on said head and spaced from said aperture for abutting second tab means adjacent said first tab means in use; and
- a lever member extending from said tool head adapted to receive handle means or act as an impact surface for imparting leverage to said head.

The tool has been found to be particularly effective in field use. By virtue of the structural features of the arrangement, the tool does not result in the consistent impact of the tabs or lugs of the hammer union, but rather engages the tabs or lugs in a manner that does not significantly damage of otherwise cause metal fatigue to the lugs. This is a pronounced advantage over existing arrangements which were limited by inducing mechanical stress to the lugs themselves.

A further significant advantage to the arrangement is that alignment is expeditiously effected; the wrench provides a head that only requires engagement with a single lug and which completely surrounds the lug in a receiving relationship. The arcuate nature and structure of the tool head also provides an abutment member which abuts the surface of the adjacent lug. In this manner, movement is quickly effected and is not so limited by the shape of the lug which may have been previously damaged by other means. This is also beneficial in that in the event that the lugs are covered with ice or other debris, such as mud, congealed oil and other material, the tool head can still be easily positioned on the hammer union owing to the fact that the tool head structure is such that the tool head overlies and receives a lug or tab. This was a significant limitation in the prior art arrangements which had to be positioned in specific alignment with two or more adjacent tabs. This would be almost impossible if lugs were out of shape or damaged in any way. With the instant arrangement, as long as there is at least some of the lug formed for the tool head to receive with an adjacent surface or partial lug, the tool can be effectively used.

In accordance with a further aspect of an embodiment of the present invention, there is provided a tool, comprising:

an arcuate tool head;

an aperture through said head for receiving first tab means of pipe fitting;

an abutment surface on said head and spaced from said aperture for abutting second tab means adjacent said first tab means in use;

a lever member extending from said tool head; and handle means adjustably connected to said arcuate tool head.

By observing specific angular relationships, the tool head can be used on its own, absent any specific handle, as the arrangement includes a lever arm extending from the tool head 8" inches, as an example. This can act as hand grip and is useful to receive a designed handle for additional leverage.

It has been found that by providing a bend in the handle itself, a significant effect is realized in augmented torque that can be applied to the hammer union. The handle not only is bent, but also the lever arm which is received by the handle. By making use of this dual angle relationship, the handle is angularly disposed relative to the vertical centre line of the tool head. It will be appreciated by those skilled that this presents a mechanical advantage from a force vector perspective that is to the advantage of the user where less effort is required in order to effect tightening or loosening of the hammer union.

In terms of materials, it has been found that hot rolled steel such as 50 W and 44 W is useful, although one skilled in the art will appreciate innumerable suitable alternatives have been found to be particularly useful for the opposition of the wrench.

Another example of material that is useful is martensitic high strength low allow steel with the following nominal chemistry:

| C % | Mn % | Cr % | Mo % | Ni % |
|---|---|---|---|---|
| 0.27 | 0.85 | 0.70 | 0.30 | 0.55 |

And mechanical properties

| Ultimate tensile strength (Ksi) | Yield strength (Ksi) | 5 Elongation | % Reduction of area | Brinelle Hardness | Charby-V notch R.T. (Ft-Lbs) |
|---|---|---|---|---|---|
| 125 to 160 | 105 to 130 | 12.0 to 20.0 | 35.0 to 60.0 | 275 to 340 | 30.0 to 50.0 |

In respect of the arrangements where the handle is used, the tool head may be interchangeable with the head itself. This would allow the handle to be used with a variety of differently sized tool heads for different hammer union arrangements.

A particularly beneficial feature of the present invention, the handle is reversible and can be positioned in two distinct ways relative to the individual tool head. This provides the user with a further degree of flexibility and/or use of the arrangement in a variety of environments. As a further advantage, it has been recognized that the tool head can be positioned closer to or further away from the terminal end of the handle. This allows for further length of the handle relative to the tool head which, of course, translates into substantial increases in the ability of the user to apply effective torque to the hammer union. Having thus generally described the invention, references will now be made to the accompanying drawings illustrating preferred embodiments.

BRIEF DESCRIPTION OF THE DRAWINGS

Similar numerals employed in the figures denote similar elements.

DETAILED DESCRIPTION OF THE PREFERRED EMBODIMENTS

Figure 1:
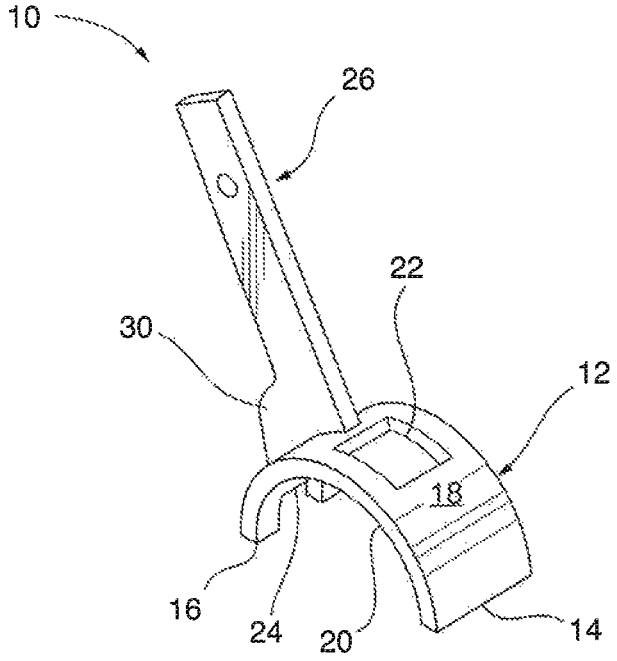
FIG. 1 is a perspective view of one embodiment of the tool head according to the present invention.

Referring now generally to the drawings, the overall arrangement is denoted by numeral 10. The tool head 10 comprises an arcuate body 12 having a first end 14 and a second opposed end 16, an outside surface 18 and an inside surface 20. The tool head 12 is generally referred to as a wrench saddle plate in other terms. Disposed within the body 12 and extending therethrough is an aperture 22, shown in the example as a generally rectangular aperture which extends completely through the body 12 from the outside surface 18 to the inside surface 20. Aperture 22 is spaced from first end 14.

Turning to end 16, the example shows a generally notch shaped cutout 24 which extends through the top surface 18 and inside surface 20. The notch 24 extends upwardly into the opposed end 16 and subscribes substantially to a rectangular configuration. The rectangular configuration of notch 24 and of aperture 22 are exemplary only. Further, it will be appreciated by those skilled in the art that notch 24 is positioned within end 16 in order to provide additional stability when the wrench is engaged with the hammer union. This will be described in greater detailed herein after.

Fixedly secured to the outside surface 18 of body 12 is a lever member, globally denoted by numeral 26. As is illustrated, the lever member 26 is positioned between aperture 22 and notch 24 and includes a lever arm 28 comprising a substantially rectangular bar, in this embodiment, which merges or connects to a reinforcing structure 30 to impart rigidity to the lever arm 28. The lever arm 28 extends upwardly and away from the arcuate body 12.

With reference to FIG. 31, shown is a view of the overall arrangement 10 as positioned on a hammer union 31. As is illustrated, the hammer union 31 includes a plurality of tabs 32 or lugs arranged peripherally about the hammer union in spaced relation.

Shown in dotted lines is a tube 34 which may be used to receive lever arm 28. This obviously has advantages from a work perspective, since the equation W=F·d is dependent on distance.

Figure 2:
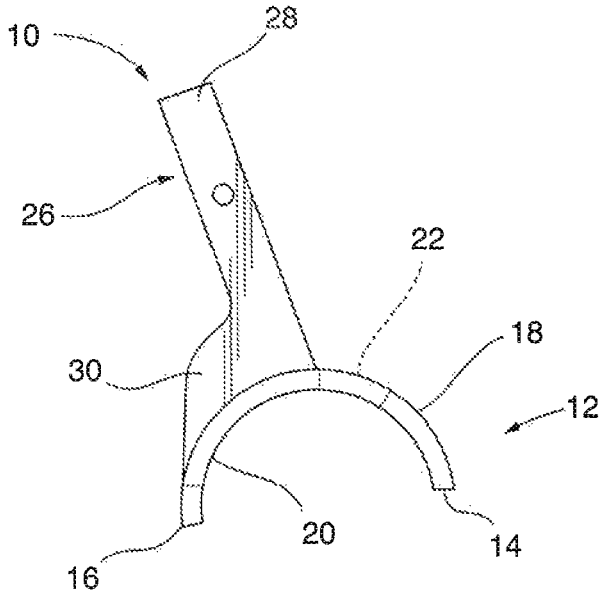
FIG. 2 is a side view of FIG. 1.

The arrangement of the overall structure has been found to be particularly effective and this effectiveness is augmented by the fact that the lever member is angularly disposed relative to the tool head 12. As is illustrated in FIG. 2, the lever arm 28 is disposed in an angle of 20 degrees relative to the center line of the tool head 12. This provides a mechanical advantage in use and reduces the amount of labor that is required for a worker to use the wrench to loosen or tighten hammer unions.

Figure 3:
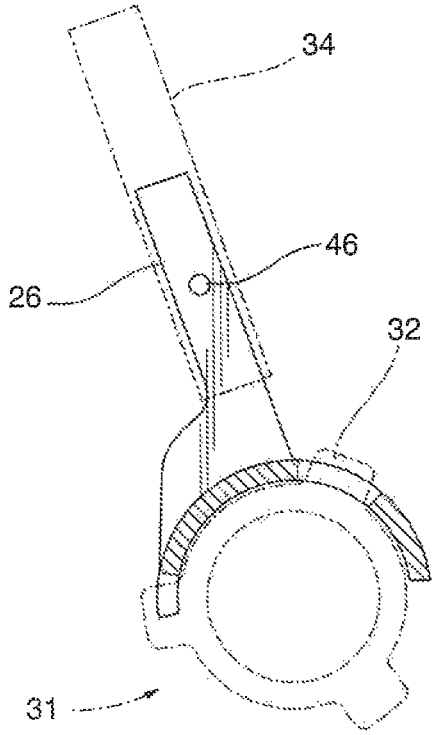
FIG. 3 is a schematic perspective view of the arrangement of FIG. 1 in use.

As will be realized from the use FIG. 3, the notch 24 is useful to provide additional stability to the tool when in position, however, it will be readily appreciated that the notch 24 could be absent the end 16 of the tool and that section of the body simply filled in to be a solid terminal end portion which simply abuts the adjacent tab or 32 lug.

Figure 4:
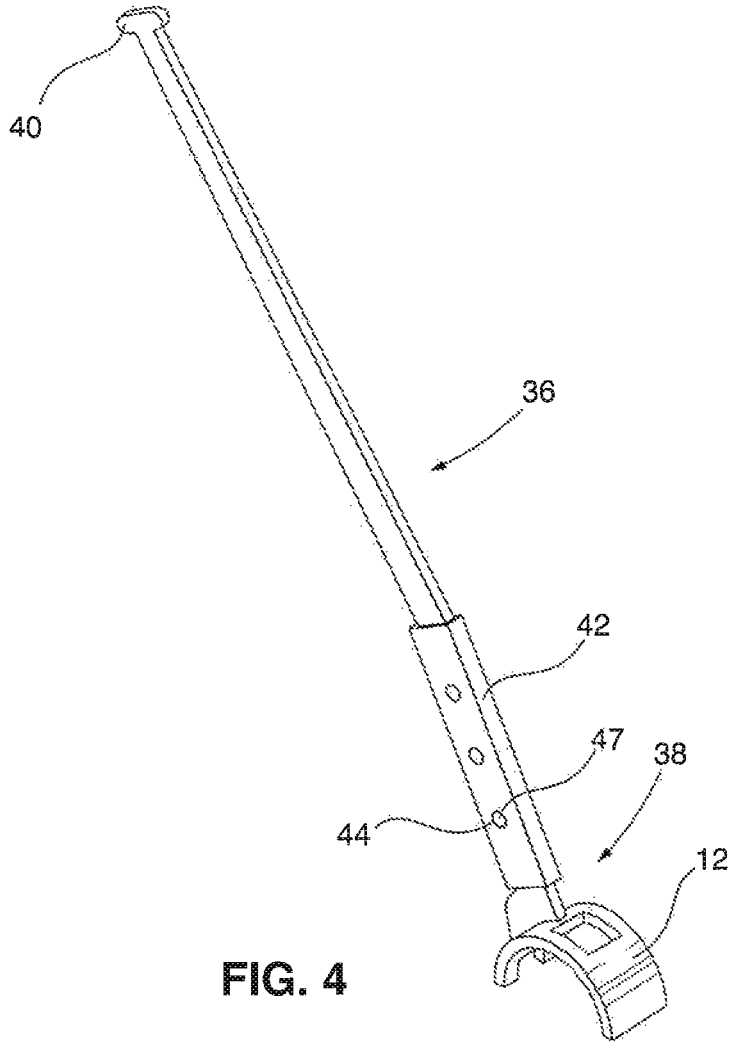
FIG. 4 is a perspective view of a further embodiment of the present invention.

Turning to FIG. 4, presented is a further embodiment of the arrangement where the tool head 12 is combined with an elongate handle 36. In this embodiment, the handle 36 includes a connection end globally denoted by numeral 38 and an opposed end 40. In the embodiment shown in FIG. 4, handle 36 is adjustably connected to the tool 10 by the connection with the lever member 26. More specifically, the handle 36 includes a connection member 42 which comprises a socket type receptacle which receives lever arm 28 therein. This is more precisely shown in FIG. 6. Those skilled in the art will appreciate that this is one possible embodiment; any number of suitable similar mechanical connections between the handle 36 and a lever arm 28 may be used. Further, it is also fully contemplated that instead of the handle 36 having the socket 42, the lever arm 28 may simply include the socket 42 for connection with handle 36. In order to facilitate connection between the handle 36 and the socket 42, an aperture 44 extending through socket 42 through both sides of the socket 42 is provided which registers with apertures 46 associated with the handle 36. A pin 47 engages the apertures 44 and 46.

Figure 6:
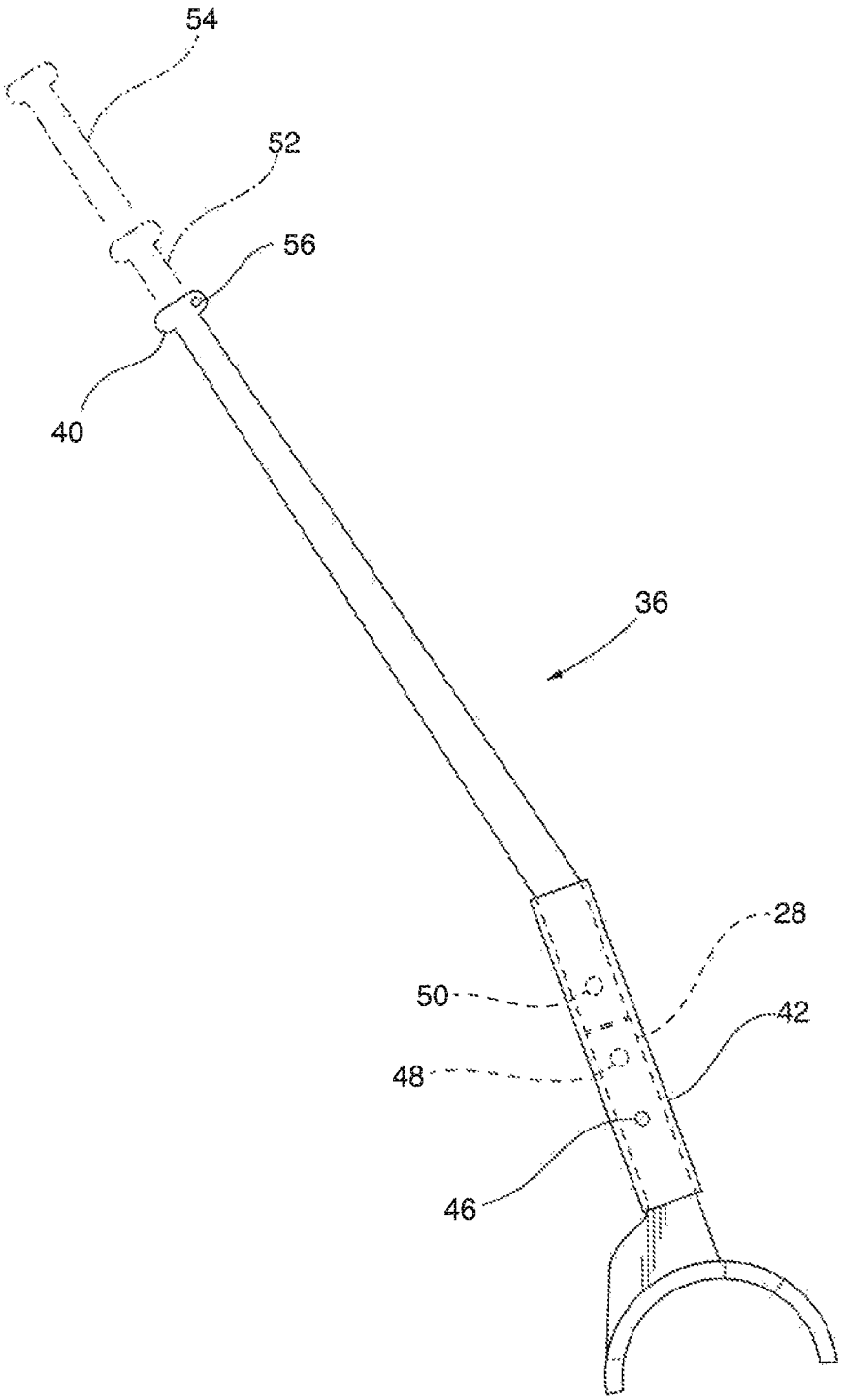
FIG. 6 is a side view of FIG. 5.

FIG. 6 illustrates additional apertures 48 and 50 joined with dashed line which may be included on handle 36 in order to extend the length of the handle further. The extension is shown towards the terminal end portion 40 in dash line represented by numerals 52 and 54. As an alternative, the additional apertures 48 and 50 can be eliminated and the handle 36 simply made longer.

Figure 5:
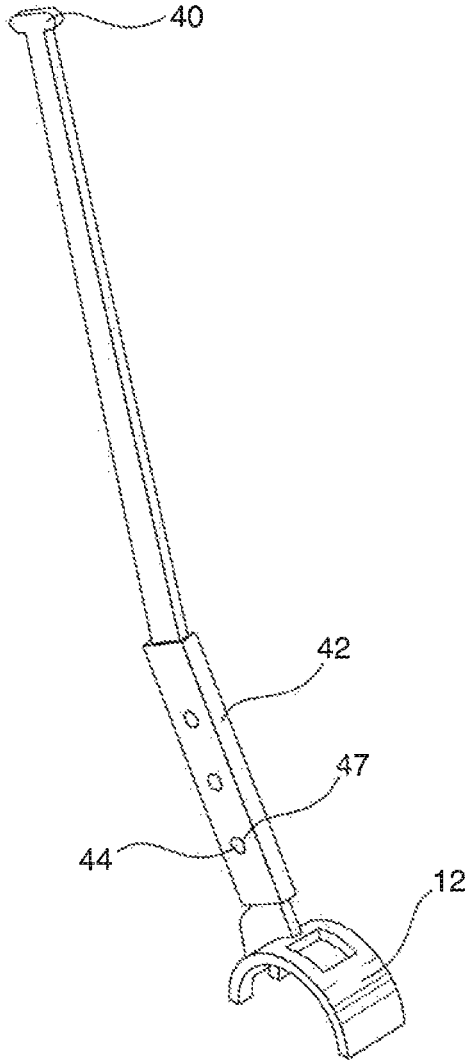
FIG. 5 is a perspective view of the present invention according to a further variation.

As is evident from FIGS. 4 through 6, the handle 36 is angularly disposed relative to the vertical axis. It has been found that by providing a bend in the handle in this manner, additional leverage can be imparted to the tool for further effective use. This is also augmented by the fact that the tool head itself and particularly the lever arm 28 as it is connected to the body presents an angular disposition. As will be appreciated by those skilled in the art, this angular disposition allows for a higher degree of torque to be applied for loosening and tightening situations, thus, reducing the amount of labor and force required by a worker to employ the use of the tool.

It has been found that an angular disposition of 11 degrees relative to the vertical axis of the handle has been particularly effective when combined with the angular disposition of the lever arm 28 relative to 12.

FIG. 5 illustrates a further embodiment of the present invention where the handle is repositioned in the opposite direction to that of FIG. 4, relative to the tool head 12. This affords a greater degree of flexibility and use for the worker and permits the use of the tool in environments where there may be clearance problems or height restrictions where the tool cannot be used in the position shown in FIG. 4.

To further augment the effectiveness of the tool, the end portion 40 of the handle 36 may include a further connection member, shown in the example as an aperture presented by numeral 56. The aperture may be useful to receive a further connection device or an additional length of handle (not shown).

Figure 7:
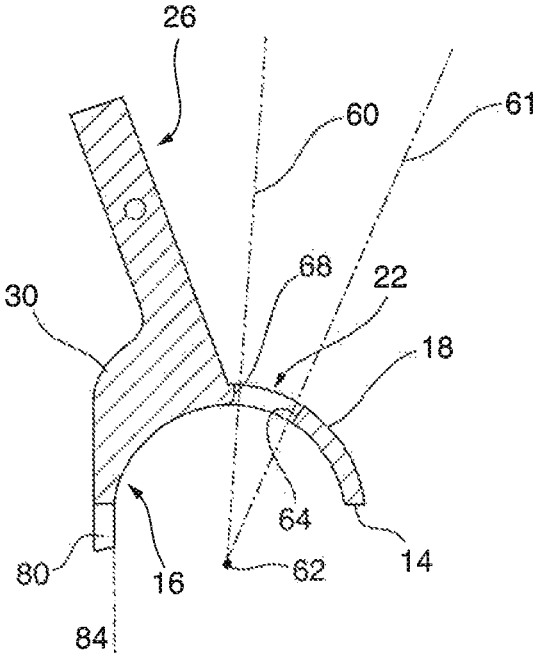
FIG. 7 is a cross sectional view of an alternate embodiment of the invention.

Referring now generally to the Figures and FIG. 7, shown is a further embodiment of the present invention. In this embodiment, the arcuate body 12 of the tool head 10 is shown in cross-section. The tool head 10 has a vertical axis from 60 centre point 62. As is evident from this cross-section, the arcuate shape of the tool head 10 is substantially semicircular. In greater detail with respect to aperture 22, it has been found that with modifications the tool can be particularly effective to prevent slipping and can accommodate a variety of tab or lug 32 sizes for different hammer unions 31. Specifically, in this embodiment, aperture 22 has a first tab contacting surface 64 and spaced therefrom a second tab contacting surface 66. The discussion will now focus on surface 64. It has been found that the effectiveness of contact of the first tab contacting surface 64 can be augmented by providing an angular inclination for the surface 64. In the embodiment shown in FIG. 7, the surface 64 can present an angle 61 relative to the vertical axis 60 between 34 and 44 degrees relative thereto. In this range of inclination, the aperture 22 can effectively accommodate any size of tab or lug 32 regardless of the degree to which it has been damaged previously from improper disconnection, such as that that has been highlighted herein previously.

Figure 8:
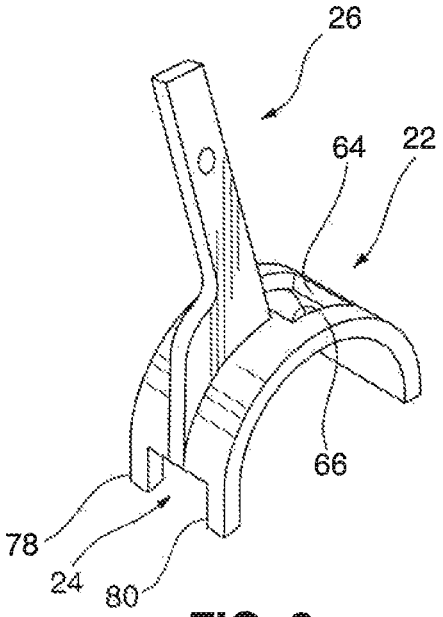
FIG. 8 is a top view of the tool of FIG. 7 as engaged with a union fitting
Figure 9:
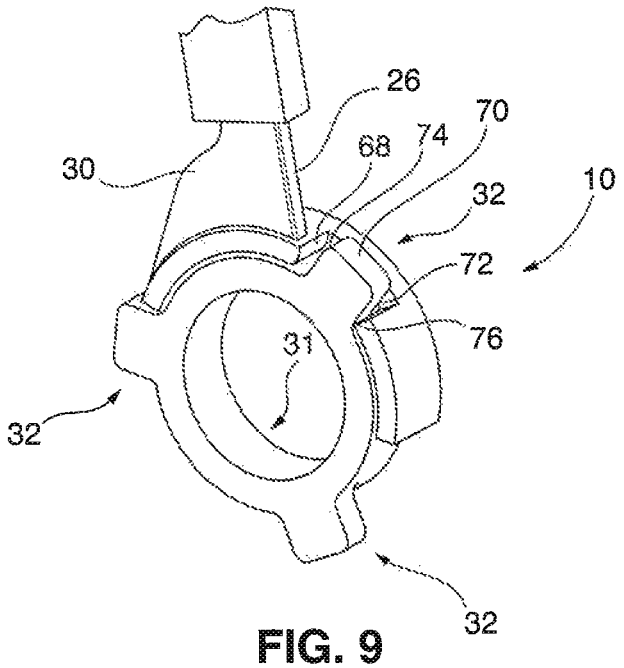
FIG. 9 is a perspective view of the tool on a fitting in the proper position.
Figure 10:
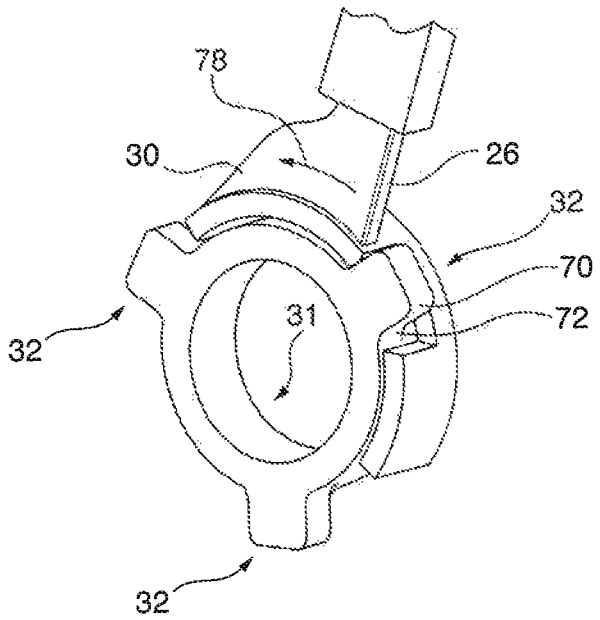
FIG. 10 is a perspective view of the tool on a fitting in the improper position.

Turning now to second tab contacting surface 66, the same includes a projection 68. As is illustrated in the Figure, the projection 68 extends inwardly of the area of the aperture 22, i.e., the projection 68 extends within the area normally adapted to receive a tab or lug 32. In the example, the projection 68 extends continuously along the width of face 66 as shown in FIG. 8. The projection 68 also extends substantially to the width of second tab contacting surface 66. As will be appreciated by those skilled in the art, the requirement of extending the width of 66 is for purposes of simplifying the manufacturing. As will become evident from the following second tab contacting face 66 need only have some degree of projection in order to function for its purpose. In terms of the purpose of projection 68, this is to prevent improper positioning of the tool head 10 about tab or lug means 32 and therefore the hammer union 31. This is shown in FIG. 9 where the tool head 10 is engaged in the proper position with one tab 32 engaged in the aperture 22 and another tab 32 received by notch 24. If the tool head 10 is positioned improperly, i.e. with projection 68 against the tab 32 as shown in FIG. 10, the projection 68 forces the disengagement of the entire tool head 10 from the hammer union 31 and tab or lug 32 when a user attempts to apply torque to the union 31. As such, projection 68 effectively forces disengagement of the tool head 10 from engaging the tab or lug means 32 and hammer union 31. This is particularly advantageous from a safety point of view.

In another specific embodiment, FIG. 8 shows the projection 68 as an arcuate projection similar to a convex projection.

The embodiment of FIG. 7 includes a further feature of the notch 24. As is evident from this embodiment and the previously discussed embodiment, the notch 24 is effectively a U-shaped notch having two legs 78 and 80 in spaced relation. From a review of FIG. 7, it will be appreciated that the arcuate shape of the tool head 10 is substantially circular relative to the radius point 62. In order to further enhance the torque application in use, at least a portion of the legs 78 and 80 are deviant from the perfect arcuate shape and specifically the radius of the arc. In this manner legs 78 and 80 are inclined relative to the radius as a tangent. This is generally illustrated by reference number 84 in FIG. 7. It has been found that the deviation with respect to the tangent of the legs 78 and 80 of the toolhead 10 further assist in the positive engagement of surface 64 with the tab or lug means 32.

As a preferred embodiment, the arcuate inclination of first tab contacting surface 64 is 42 degrees.

In respect of FIG. 9, a tab or lug 32 includes a top surface 70 as well as a connection point or interface of the tab 32 at 74 and 76. As illustrated in FIG. 9, in proper use, the connection point interface 76 is positively engaged within the aperture 22 and more particularly, first tab contacting surface 64. By virtue of the angular disposition previously discussed for first tab contacting surface 64, a very positive engagement is effected at interface 72. In contrast, if the tool head 10 is attempted to be used in the position of FIG. 10 for tightening or otherwise moving the hammer union 31, the result is that the projection 68 is urged into contact with interface or connection point 74 which is ineffective for contact and results in disengagement of the tool head 10 from tab 32 and therefore hammer union 31.

Figure 11:
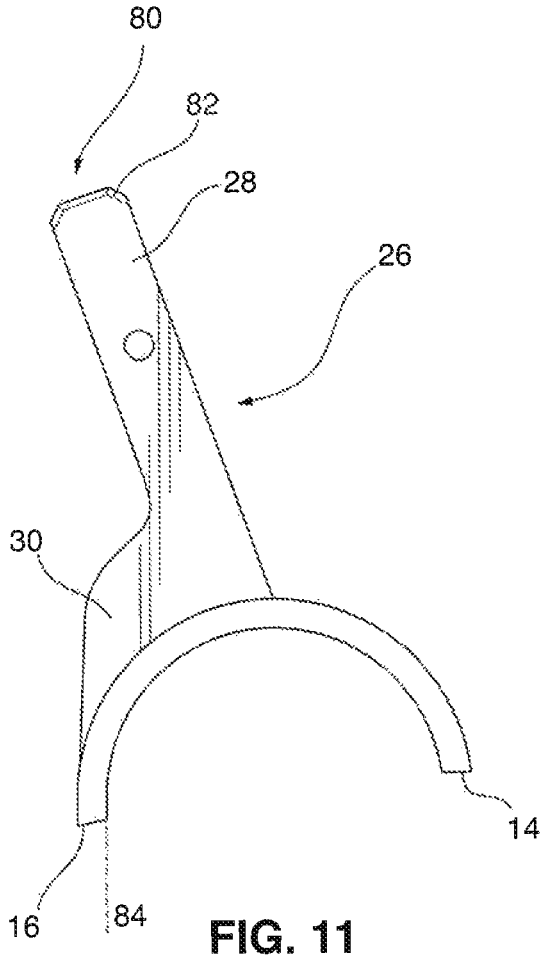
FIG. 11 is a perspective view of yet another embodiment of the present invention.

Turning to FIG. 11, shown is a side view of a further embodiment of the tool head 10. In this embodiment, modifications are made to the lever member and specifically lever arm 28. The terminal end 80 of the lever arm 28 includes a contoured surface for helping in aligning the handle 36 (shown in FIG. 6) for position purposes on lever arm 28. In the example shown, the countered surface comprises a series of chamfers 82 on both sides of the end 80 of the arm 28.

With this modification, the positioning of the handle over the lever is simplified and this forgives any molding imperfections in the receiving area in the handle such as an imperfection in the cross-section which would make the connection between the lever arm 28 and the handle 36 less than ideal.

By providing a contoured surface of chamfers 82 as shown in the example, this is substantially obviated and ensures a positive connection between the lever arm 28 and the handle 26. It will be appreciated by those skilled in the art that the contour can be on both sides of the end 80 of the arm 28 or a single side thereof. Further, the contour need not be chamfers, the contour may comprised of an arcuate profile.

Although embodiments of the invention have been described above, it is not limited thereto and it will be apparent to those skilled in the art that numerous modifications form part of the present invention insofar as they do not depart from the spirit, nature and scope of the claimed and described invention.

The invention claimed is:

1. A tool, comprising: an arcuate tool head; an aperture through said head for receiving first tab means of a fitting, said aperture having a first tab contacting face and a second tab contacting face spaced therefrom; an abutment surface on said head and spaced from said aperture for abutting second tab means adjacent said first tab means in use; projection means on said second tab contacting face for preventing improper positioning of said head relative to said tab means in use; and a lever member extending from said tool head adapted to receive handle means or act as an impact surface for imparting leverage to said head.

2. The tool as set forth in claim 1, wherein said arcuate tool head is substantially semicircular having a radius.

3. The tool as set forth in claim 1, wherein said first tab contacting face has a top edge and a bottom edge spaced therefrom.

4. The tool as set forth in claim 3, wherein said bottom edge is configured to contact a connection interface of said tab means and said fitting.

5. The tool as set forth in claim 1, wherein said first tab contacting face is at an angle of between 34 and 44 degrees relative to a vertical axis of said arcuate tool head.

6. The tool as set forth in claim 5, wherein said is at an angle of 42 degrees relative to the vertical axis of said arcuate tool head.

7. The tool as set forth in claim 1, wherein said projection means on said second tab contacting face comprises a non-planar projection extending from said second tab contacting face.

8. The tool as set forth in claim 7, wherein said projection means extends into area of said aperture for receiving said first tab means.

9. The tool as set forth in claim 1, wherein said projection means comprises an arcuate projection.

10. The tool as set forth in claim 9, wherein said arcuate projection extends substantially the width of said second tab contacting face.

11. The tool as set forth in claim 9, wherein said arcuate projection extends continuously along the width of said second tab contacting face.

12. The tool as set forth in claim 9, wherein said arcuate projection extends continuously along the length of said second tab contacting face.

13. The tool as set forth in claim 1, wherein said wherein said abutment surface comprises a notch for accommodating at least a portion of said second tab means.

14. The tool as set forth in claim 13, wherein said notch comprises a substantially U shaped notch.

15. The tool as set forth in claim 14, wherein legs of said U shaped notch are angularly disposed relative to the radius of said arcuate tool head.

16. The tool as set forth in claim 15, wherein at least a portion of said legs of said U-shaped notch are tangentially disposed relative to the radius of said arcuate tool head.

17. The tool as set forth in claim 1, wherein said lever member is secured to said head between said abutment surface and said aperture.

18. The tool as set forth in claim 1, wherein said lever member includes a terminal end portion, said terminal end portion having a contoured surface adapted to receive a handle.

19. The tool as set forth in claim 18, wherein said contoured surface comprises at least one chamfer.

20. The tool as set forth in claim 19, wherein said contoured surface comprises at least a pair of chamfers.

21. A tool, comprising: an arcuate tool head; an aperture through said head for receiving first tab means of pipe fitting, said aperture having a first tab contacting face and a second tab contacting face spaced therefrom; an abutment surface on said head and spaced from said aperture for abutting second tab means adjacent said first tab means in use; projection means on said second tab contacting face for preventing improper positioning of said head relative to said tab means in use; a lever member extending from said tool head adapted to receive handle means or act as an impact surface for imparting leverage to said head a lever member extending from said tool head; and handle means adjustably connected to said arcuate tool head.

22. The tool as set forth in claim 21, wherein said handle having a connection end and an opposed second end and including a bend proximate said connection end.

23. The tool as set forth in claim 21, wherein said arcuate tool head is substantially semicircular having a radius.

24. The tool as set forth in claim 21, wherein said first tab contacting face has a top edge and a bottom edge spaced therefrom.

25. The tool as set forth in claim 24, wherein said bottom edge is configured to contact a connection interface of said tab means and said fitting.

26. The tool as set forth in claim 21, wherein said first tab contacting face is at an angle of between 34 and 44 degrees relative to a vertical axis of said arcuate tool head.

27. The tool as set forth in claim 26, wherein said is at an angle of 42 degrees relative to the vertical axis of said arcuate tool head.

28. The tool as set forth in claim 27, wherein said projection means extends into area of said aperture for receiving said first tab means.

29. The tool as set forth in claim 21, wherein said projection means on said second tab contacting face comprises a nonplanar projection extending from said second tab contacting face.

30. The tool as set forth in claim 21, wherein said projection means comprises an arcuate projection.

31. The tool as set forth in claim 21, wherein said contoured surface comprises at least a pair of chamfers.

* * * * *